United States Patent [19]

Ishizuka et al.

[11] Patent Number: 4,567,371

[45] Date of Patent: Jan. 28, 1986

[54] RADIATION IMAGE STORAGE PANEL

[75] Inventors: Akio Ishizuka, Fujinomiya; Hisashi Yamazaki; Kikuo Yamazaki, both of Kaisei, all of Japan

[73] Assignee: Fuji Photo Film Co., Ltd., Japan

[21] Appl. No.: 635,835

[22] Filed: Jul. 30, 1984

[30] Foreign Application Priority Data

Feb. 8, 1983 [JP] Japan ..... 58-141458

[51] Int. Cl.[4] ..... G03C 5/16

[52] U.S. Cl. ..... 250/483.1; 250/327.2

[58] Field of Search ..... 250/327.2, 483.1, 484.1

[56] References Cited

U.S. PATENT DOCUMENTS 4,510,388 4/1985 Yamazaki et al. ..... 250/483.1

*Primary Examiner*—Alfred E. Smith

*Assistant Examiner*—Richard Hanig

*Attorney, Agent, or Firm*—Murray, Whisenhunt and Ferguson

[57] ABSTRACT

A radiation image storage panel comprising a support, a subbing layer and a phosphor layer which comprises a binder and a stimulable phosphor dispersed therein, superposed in this order, characterized in that said subbing layer contains fine particles having a size of 1–30 μm in an amount of 1–200% by weight of a resin constituting the subbing layer.

8 Claims, No Drawings

RADIATION IMAGE STORAGE PANEL

BACKGROUND OF THE INVENTION

1. Field of the Invention

This invention relates to a radiation image storage panel and more particularly, to a radiation image storage panel comprising a support, a subbing layer and a phosphor layer, superposed in this order.

2. Description of Prior Arts

For obtaining a radiation image, there has been conventionally employed a radiography utilizing a combination of a radiographic film having an emulsion layer containing a photosensitive silver salt material and a radiographic intensifying screen.

As a method replacing the above-described radiography, a radiation image recording and reproducing method utilizing a stimulable phosphor as described, for instance, in U.S. Pat. No. 4,239,968, has been recently paid much attention. In the radiation image recording and reproducing method, a radiation image storage panel comprising a stimulable phosphor (i.e., stimulable phosphor sheet) is used, and the method involves steps of causing the stimulable phosphor of the panel to absorb radiation energy having passed through an object or having radiated from an object; exciting the stimulable phosphor with an electromagnetic wave such as visible light and infrared rays (hereinafter referred to as "stimulating rays") to sequentially release the radiation energy stored in the stimulable phosphor as light emission (stimulated emission); photoelectrically detecting the emitted light to obtain electric signals; and reproducing the radiation image of the object as a visible image from the electric signals.

In the radiation image recording and reproducing method, a radiation image can be obtained with a sufficient amount of information by applying a radiation to the object at considerably smaller dose, as compared with the case of utilizing the conventional radiography. Accordingly, this radiation image recording and reproducing method is of great value especially when the method is used for medical diagnosis.

The radiation image storage panel employed in the radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock.

The phosphor layer comprises a binder and stimulable phosphor particles dispersed therein. The stimulable phosphor emits light (stimulated emission) when excited with stimulating rays after having been exposed to a radiation such as X-rays. Accordingly, the radiation having passed through an object or having radiated from an object is absorbed by the phosphor layer of the radiation image storage panel in proportion to the applied radiation dose, and the radiation image of the object is produced in the radiation image storage panel in the form of a radiation energy-stored image (latent image). The radiation energy-stored image can be released as stimulated emission by applying stimulating rays to the panel, for instance, by scanning the panel with stimulating rays. The stimulated emission is then photoelectrically detected to give electric signals, so as to reproduce a visible image from the electric signals.

The radiation image storage panel employed in the above-described method is handled differently from the radiographic intensifying screen employed in the conventional radiography. That is, the panel is subjected to transferring operation, piling operation and the like in each use to read out the radiation energy stored in the panel under excitation with stimulating rays. Accordingly, the panel frequently encounters mechanical shock and receives mechanical force in the course of transferring or piling, and hence it is desired that the panel has a high mechanical strength and a high resistance to flexing.

More in detail, the radiation image storage panel is required to have high mechanical strength so as not to allow easy separation of the phosphor layer from the support, when the mechanical shock and mechanical force caused by falling or bending of the panel are applied to the panel in the use. Since the radiation image storage panel hardly deteriorates upon exposure to a radiation or to an electromagnetic wave ranging from visible light to infrared rays, the panel can be repeatedly employed for a long period of time. Accordingly, the panel subjected to the repeated use is required not to encounter such troubles as the separation between the phosphor layer and support caused by the mechanical shock applied in handling of the panel in a procedure of exposing the panel to a radiation, in a procedure of reproducing a visible image brought about by excitating the panel with an electromagnetic wave after the exposure to the radiation, and in a procedure of erasing the radiation image remaining in the panel.

The radiation image storage panel has a tendency that the bonding strength between the phosphor layer and the support decreases as the mixing ratio of the binder to the stimulable phosphor (binder/stimulable phosphor) in the phosphor layer is decreased in order to enhance the sensitivity of the panel. The bonding strength therebetween also tends to decrease in the case that the phosphor layer is formed on the support under such conditions as to deposit the phosphor particles on the lower side (i.e., the support side), which takes place depending upon the nature of phosphor particles and binder, the coating conditions of the binder solution (coating dispersion), etc.

It has been known that, for enhancing the bonding strength between the phosphor layer and the support which is apt to decrease as described above, a subbing layer is provided between the phosphor layer and the support. Such subbing layer is formed using a known adhesive agent comprising a synthetic resin. However, when a layer of coating dispersion for the phosphor layer is formed on the surface of the conventional subbing layer provided on the support, the subbing layer is once swollen by the solvent contained in the coating dispersion and then shrinked, so that cracks are apt to occur on the resulting phosphor layer. Especially in the case that the subbing layer is flexible and the binder of the phosphor layer is relatively rigid, cracks are probably produced in the phosphor layer. Since the occurrence of cracks in the phosphor layer results in not only decreasing the mechanical strength of the panel but also deteriorating the quality of an image provided by the panel, it is required to prevent the phosphor layer from occurrence of cracks.

In the radiation image storage panel having a protective film provided on the phosphor layer, the protective film is usually provided by laminating the surface of the phosphor layer with the film using an adhesive agent under heating and pressure. In the case that the subbing layer is not sufficiently rigid, a portion of the subbing layer is depressed or dislocated in the laminating procedure to bring about uneveness of the thickness thereof or dislocation of the phosphor layer from the support. As a result of such plastic deformation, there occur such troubles that wrinkles (lamination wrinkles) are likely produced on the surface of the protective film of the resulting panel, or the panel is entirely deformed to have a curved face (namely, curling).

SUMMARY OF THE INVENTION

It is an object of the present invention to provide a radiation image storage panel which is substantially free from the occurrence of cracks in the phosphor layer.

It is another object of the present invention to provide a radiation image storage panel which is reduced in the production of lamination wrinkles or the production of curling of the panel in the procedure of laminating a protective film.

The above-mentioned objects are accomplished by the radiation image storage panel of the present invention comprising a support, a subbing layer and a phosphor layer which comprises a binder and a stimulable phosphor dispersed therein, superposed in this order, characterized in that said subbing layer contains fine particles having a size of 1-30 μm in an amount of 1-200% by weight of a resin constituting the subbing layer.

DETAILED DESCRIPTION OF THE INVENTION

In the radiation image storage panel of the present invention, effective prevention of occurrence of cracks in the phosphor layer as well as prominent enhancement of mechanical strength of the panel are achieved by employing as the subbing layer a resin layer containing fine particles.

More in detail, the addition of fine particles to a subbing layer makes it so rigid that the degree of swelling and shrinking of the subbing layer which is caused by a solvent of a coating dispersion for the phosphor layer in the procedure for forming the phosphor layer is reduced to a low level. As a result, the occurrence of cracks in the phosphor layer, which is apt to occur in the conventional radiation image storage panel having a phosphor layer provided on a subbing layer having no fine particles, is effectively reduced. Accordingly, the radiation image storage panel of the present invention can provide an image of high quality.

Further, the rigid subbing layer containing fine particles is resistant against shearing stress. In the case of providing a protective film of plastic material onto the phosphor layer by lamination, the occurrence of wrinkles on the surface of the protective film and the curling of the panel which are generally observed in the conventional panel owing to the plastic deformation of the subbing layer are effectively prevented or remarkably reduced. Accordingly, the procedure of laminating the protective film is rendered easier than the conventional procedure, and further the resulting radiation image storage panel can provide an image of high quality.

The subbing layer into which fine particles are incorporated according to the present invention is slightly reduced in the strength for bonding the phosphor layer and the support in the resulting radiation image storage panel. However, the bonding strength therebetween in the panel of the present invention is sufficiently higher than that of a panel having no subbing layer. The panel of the present invention has prominently high mechanical strength against the mechanical shocks such as given in falling or bending the panel as compared with the panel having no subbing layer. Accordingly, the incorporation of fine particles into the subbing layer does not so reduce the effect of improving the bonding strength brought about by the provision of the subbing layer.

The radiation image storage panel of the present invention having the above-described advantages can be prepared, for instance, in the following manner.

The subbing layer, that is a characteristic requisite of the present invention, comprises a resin and fine particles dispersed therein.

As for the fine particles, any particulate material can be employed in the present invention, provided that the particles can be dispersed in the resin to make the subbing layer rigid. The fine particles necessarily have a size (namely, diameter) within the range of from 1 to 30 μm, and particularly of from 1 to 10 μm.

Examples of the fine particles employable in the present invention include silicon dioxide, titanium dioxide, aluminum oxide, magnesium oxide, alkaline earth metal fluorohalide, carbon black, and the particulate stimulable phosphors as described hereinafter.

Examples of the resin include polyacrylic resins, polyester resins, polyurethane resins, polyvinyl acetate resins and ethylene-vinyl acetate copolymers. The resins employable for the formation of the subbing layer are not restricted to the above resins and any other resin (adhesive agent) conventionally employed for the formation of the subbing layer can be employed in the present invention.

The resin of the subbing layer is preferably crosslinked with a crosslinking agent such as an aliphatic isocyanate, an aromatic isocyanate, melamine, an amino resin or a derivative of one of these compounds.

The subbing layer can be formed on the support by the following procedure. A resin and fine particles are added to an appropriate solvent and they are well mixed to prepare a coating dispersion. From the viewpoint of prevention of occurrence of cracks, prevention of production of lamination wrinkles and curling of the panel in the lamination procedure, and enhancement of the bonding strength between the phosphor layer and the support, the fine particles are preferably incorporated in an amount ranging from 1 to 200% by weight of the resin. The content of the fine particles varies depending on characteristics of the radiation image storage panel, particle size thereof, kind of resin of the subbing layer, etc. The content of the fine particles preferably is in the range of 5-99% by weight of the resin and more preferably 10-60% by weight.

The solvent employable in the preparation of the coating dispersion can be selected from solvents employable in the preparation of a phosphor layer mentioned below. The coating dispersion is uniformly applied onto the surface of the support to form a layer of the coating dispersion. The coating procedure can be carried out by a conventional method such as a method using a doctor blade, a roll coater or a knife coater. Subsequently, the coating dispersion layer is heated slowly to dryness so as to complete the formation of a subbing layer.

Thus, a rigid subbing layer comprising the resin and the fine particles dispersed therein is formed on the support. The thickness of the subbing layer varies depending on characteristics of the radiation image storage panel, materials employed in the phosphor layer and the support, and kinds of the resin and fine particles. Preferably, the thickness of the subbing layer ranges from 3 to 50 μm.

The support material employed in the present invention can be selected from those employed in the conventional radiographic intensifying screens or those employed in the known radiation image storage panels. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, a light-reflecting layer or a light-absorbing layer is occasionally provided on the support so as to improve the sensitivity of the panel or the quality of the image provided thereby. The light-reflecting layer or light-absorbing layer may be provided by forming a polymer material layer containing a light-reflecting material such as titanium dioxide or a light-absorbing material such as carbon black. In the invention, one or more of these additional layers may be provided on the support.

As described in Japanese Patent Provisional Publication No. 58(1983)-200200 (corresponding to U.S. patent application Ser. No. 496,278 and European Patent Publication No. 92241), the phosphor layer-side surface of the support having the subbing layer (i.e., the surface of the subbing layer) may be provided with protruded and depressed portions for enhancement of the sharpness of the image.

On the subbing layer prepared as described above, a phosphor layer is formed. The phosphor layer comprises a binder and stimulable phosphor particles dispersed therein.

The stimulable phosphor, as described hereinbefore, gives stimulated emission when excited with stimulating rays after exposure to a radiation. From the viewpoint of practical use, the stimulable phosphor is desired to give stimulated emission in the wavelength region of 300–500 nm when excited with stimulating rays in the wavelength region of 400–850 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8 \leqq x \leqq 10$, and $M^{2+}O.xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in Japanese Patent Provisional Publication No. 55(1980)-12145;

$M^{II}FX.xA:yLn$, in which $M^{II}$ is at least one element selected from the group consisting of Ba, Ca, Sr, Mg, Zn and Cd; A is at least one compound selected from the group consisting of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$ and $ThO_2$; Ln is at least one element selected from the group consisting of Eu, Tb, Ce, Tm, Dy, Pr, Ho, Nd, Yb, Er, Sm and Gd; X is at least one element selected from the group consisting of Cl, Br and I; and x and y are numbers satisfying the conditions of $5 \times 10^{-5} \leqq x \leqq 0.5$ and $0<y \leqq 0.2$, respectively, as described in Japanese Patent Provisional Publication No. 55(1980)-160078;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of Zr and Sc; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 10^{-2}$, respectively, as described in Japanese Patent Provisional Publication No. 56(1981)-116777;

$(Ba_{1-x},M^{II}_x)F_2.aBaX_2:yEu,zB$, in which $M^{II}$ is at least one element selected from the group consisting of Be, Mg, Ca, Sr, Zn and Cd; X is at least one element selected from the group consisting of Cl, Br and I; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 2 \times 10^{-1}$, respectively, as described in Japanese Patent Provisional Publication No. 57(1982)-23673;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of As and Si; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 5 \times 10^{-1}$, respectively, as described in Japanese Patent Provisional Publication No. 57(1982)-23675;

$M^{III}OX:xCe$, in which $M^{III}$ is at least one trivalent metal selectd from the group consisting of Pr, Nd, Pm, Sm, Eu, Tb, Dy, Ho, Er, Tm, Yb, and Bi; X is at least one element selected from the group consisting of Cl and Br; and x is a number satisfying the condition of $0<x<0.1$, as described in Japanese Patent Provisional Publication No. 58(1983)-69281;

$Ba_{1-x}M_{x/2}L_{x/2}FX:yEu^{2+}$, in which M is at least one alkali metal selected from the group consisting of Li, Na, K, Rb and Cs; L is at least one trivalent metal selected from the group consisting of Sc, Y, La, Ce, Pr, Nd, Pm, Sm, Gd, Tb, Dy, Ho, Er, Tm, Yb, Lu, Al, Ga, In and Tl; X is at least one halogen selected from the group consisting of Cl, Br and I; and x and y are numbers satisfying the conditions of $10^{-2}\leqq x\leqq 0.5$ and $0<y\leqq 0.1$, respectively, as described in Japanese Patent Provisional Publication No. 58(1983)-206678;

$BaFX.xA:yEu^{2+}$, in which X is at least one halogen selected from the group consisting of Cl, Br and I; A is at least one fired product of a tetrafluoroboric acid compound; and x and y are numbers satisfying the conditions of $10^{-6}\leqq x\leqq 0.1$ and $0<y\leqq 0.1$, respectively, as described in Japanese Patent Provisional Publication No. 59(1984)-27980;

$BaFX.xA:yEu^{2+}$, in which X is at least one halogen selected from the group consisting of Cl, Br and I; A is at least one fired product of a hexafluoro compound selected from the group consisting of monovalent and divalent metal salts of hexafluoro silicic acid, hexafluoro titanic acid and hexafluoro zirconic acid; and x and y are numbers satisfying the conditions of $10^{-6}\leqq x\leqq 0.1$ and $0<y\leqq 0.1$, respectively, as described in Japanese Patent Provisional Publication No. 59(1984)-47289;

$BaFX.xNaX':aEu^{2+}$, in which each of X and X' is at least one halogen selected from the group consisting of Cl, Br and I; and x and a are numbers satisfying the conditions of $0<x\leqq 2$ and $0<a\leqq 0.2$, respectively, as described in Japanese Patent Provisional Publication No. 59(1984)-56479;

$M^{II}FX.xNaX':yEu^{2+}:zA$, in which $M^{II}$ is at least one alkaline earth metal selected from the group consisting of Ba, Sr and Ca; each of X and X' is at least one halogen selected from the group consisting of Cl, Br and I; A is at least one transition metal selected from the group consisting of V, Cr, Mn, Fe, Co and Ni; and x, y and z are numbers satisfying the conditions of $0<x\leqq 2$, $0<y\leqq 0.2$ and $0<z\leqq 10^{-2}$, respectively, as described in Japanese Patent Provisional Publication No. 59(1984)-56480; and $M^{II}FX.aM^{I}X'.bM'^{II}X''_2.cM^{III}X'''_3.xA:yEu^{2+}$, in which $M^{II}$ is at least one alkaline earth metal selected from the group consisting of Ba, Sr and Ca; $M^{I}$ is at least one alkali metal selected from the group consisting of Li, Na, K, Rb and Cs; $M'^{II}$ is at least one divalent metal selected from the group consisting of Be and Mg; $M^{III}$ is at least one trivalent metal selected from the group consisting of Al, Ga, In and Tl; A is at least one metal oxide; X is at least one halogen selected from the group consisting of Cl, Br and I; each of X', X'' and X''' is at least one halogen selected from the group consisting of F, Cl, Br and I; a, b and c are numbers satisfying the conditions of $0\leqq a\leqq 2$, $0\leqq b\leqq 10^{-2}$, $0\leqq c\leqq 10^{-2}$ and $a+b+c\geqq 10^{-6}$; and x and y are numbers satisfying the conditions of $0<x\leqq 0.5$ and $0<y\leqq 0.2$, respectively, as described in Japanese Patent Provisional Publicaiton No. 59(1984)-75200.

The above-described stimulable phosphors are given by no means to restrict the stimulable phosphor employable in the present invention. Any other phosphor can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polyalkyl(meth)acrylate, vinyl chloride-vinyl acetate copolymer, polyurethane, cellulose acetate butyrate, polyvinyl alcohol, and linear polyester. Particularly preferred are nitrocellulose, linear polyester, polyalkyl(meth)acrylate, a mixture of nitrocellulose and linear polyester, and a mixture of nitrocellulose and polyalkyl(meth)acrylate. The binder may be crosslinked with a crosslinking agent.

The phosphor layer can be formed on the subbing layer, for instance, by the following procedure.

In the first place, stimulable phosphor particles and a binder are added to an appropriate solvent, and then they are mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the stimulable phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:50.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly to the surface of the subbing layer to form a layer of the coating dispersion. The coating procedure can be carried out by a conventional method such as a method using a doctor blade, a roll coater or a knife coater.

After applying the coating dispersion to the subbing layer, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within the range of from 20 μm to 1 mm, and preferably from 50 to 500 μm.

The radiation image storage panel generally has a transparent film on the free surface of the phosphor layer to protect the phosphor layer from physical and chemical deterioration. In the radiation image storage panel of the present invention, it is preferable to provide a transparent film for the same purpose.

The transparent film can be provided onto the phosphor layer by beforehand preparing it from a polymer such as polyethylene terephthalate, polyethylene, polyvinylidene chloride or polyamide, followed by laminating it onto the phosphor layer using an appropriate adhesive agent. In the present invention, the subbing layer which is made rigid by the incorporation of the fine particles thereto is provided between the support and the phosphor layer, so that the wrinkles are hardly produced on the surface of the protective film, and the resulting panel is hardly curled even after the protective film is provided on the phosphor layer by the lamination procedure.

Alternatively, the transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. The transparent protective film preferably has a thickness within a range of approx. 3 to 20 μm.

The radiation image storage panel of the present invention may be colored with such a colorant that the mean reflectance thereof in the wavelength region of stimulating rays for the stimulable phosphor is smaller than that in the wavelength region of stimulated emission to improve the sharpess of the image provided thereby as described in Japanese Patent Provisional Publication No. 57(1982)-96300.

The following examples will illustrate the present invention, but these examples are by no means to restrict the invention. In the following examples, the term of "part" means "part by weight", unless otherwise specified.

EXAMPLE 1

A polyacrylic resin (trade name: Criscoat P-1018GS, available from Dainippon Ink & Chemical Inc., Japan), aliphatic isocyanate (crosslinking agent; trade name: Sumidul N, available from Sumitomo Bayer Urethane Co., Ltd., Japan) and fine particles of silicon dioxide (diameter: 2–3 μm) were added to methyl ethyl ketone to prepare a coating dispersion.

| Composition of Coating Dispersion for Subbing Layer | |
|---|---|
| Polyacrylic resin | 100 parts |
| Aliphatic isocyanate | 3 parts |
| Silicon dioxide | 20 parts |
| Methyl ethyl ketone | 1127 parts |

Then, the coating dispersion was evenly applied onto a polyethylene terephthalate film containing carbon black (support, thickness: 250 μm) placed horizontally on a glass plate. The application of the coating dispersion was carried out using a doctor blade. After the coating was complete, the support having a layer of the coating dispersion was heated to dryness in an oven to prepare a subbing layer having thickness of approx. 30 μm on the support.

To a mixture of a particulate divalent europium activated alkaline earth metal fluorobromide ($BaFBr:Eu^{2+}$) phosphor and nitrocellulose was added methyl ethyl ketone, to prepare a dispersion containing the binder and phosphor particles in the ratio of 1:18 (binder:phosphor, by weight). Tricresyl phosphate, n-butanol and methyl ethyl ketone were then added to the dispersion and the mixture was sufficiently stirred by means of a propeller agitator to obtain a homogeneous coating dispersion having a viscosity of 25–35 PS (at 25° C.).

| Composition of Coating Dispersion for Phosphor Layer | |
|---|---|
| $BaFBr:Eu^{2+}$ phosphor | 500 parts |
| Nitrocellulose | 27.2 parts |
| Tricresyl phosphate | 0.5 part |
| n-Butanol | 5.7 parts |
| Methyl ethyl ketone | 75 parts |

Then, the coating dispersion was evenly applied onto the surface of the subbing layer provided on the support. The application of the coating dispersion was carried out using a doctor blade. After the coating was complete, the support having a layer of the coating dispersion was heated to dryness for 10 min. under air stream at 90° C. and at a flow rate of 1.0 m/sec. Thus, a phosphor layer having thickness of approx. 250 μm was formed on the support.

On the phosphor layer was placed a polyethylene terephthalate transparent film (thickness: 12 μm; provided with a polyester adhesive layer on one surface) to bond the film and the phosphor layer by the adhesive layer. Thus, a radiation image storage panel consisting essentially of a support, a subbing layer, a phosphor layer and a transparent protective film was prepared.

EXAMPLE 2

A radiation image storage panel consisting essentially of a support, a subbing layer, a phosphor layer and a transparent protective film was prepared in the same manner as described in Example 1, except that a polyester resin (trade name: Vylon 30P, available from Toyobo Co., Ltd., Japan), methylated melamine (crosslinking agent; trade name: Sumimal M-40S, available from Sumitomo Chemical Co., Ltd., Japan) and fine particles of silicon dioxide (diameter: 2–3 μm) were added to ethylene dichloride to prepare a coating dispersion for the subbing layer having the following composition.

| Composition of Coating Dispersion for Subbing Layer | |
|---|---|
| Polyester resin | 100 parts |
| Methylated melamine | 25 parts |
| Silicon dioxide | 20 parts |
| Ethylene dichloride | 1375 parts |

EXAMPLE 3

A radiation image storage panel consisting essentially of a support, a subbing layer, a phosphor layer and a transparent protective film was prepared in the same manner as described in Example 1, except that a polyurethane resin (trade name: Crisvon NT-150, available from Dainippon Ink & Chemicals Inc., Japan) and fine particles of silicon dioxide (diameter: 2–3 μm) were added to methyl ethyl ketone to prepare a coating dispersion for the subbing layer having the following composition.

| Composition of Coating Dispersion for Subbing Layer | |
|---|---|
| Polyurethane resin | 100 parts |
| Silicon dioxide | 20 parts |
| Methyl ethyl ketone | 1150 parts |

COMPARISON EXAMPLE 1

A radiation image storage panel consisting essentially of a support, a subbing layer, a phosphor layer and a transparent protective film was prepared in the same manner as described in Example 1, except that fine particles of silicon dioxide were not added to the coating dispersion to prepare a coating dispersion for the subbing layer having the following composition.

| Composition of Coating Dispersion for Subbing Layer | |
|---|---|
| Polyacrylic resin | 100 parts |
| Aliphatic isocyanate | 3 parts |
| Methyl ethyl ketone | 1127 parts |

COMPARISON EXAMPLE 2

A radiation image storage panel consisting essentially of a support, a subbing layer, a phosphor layer and a transparent protective film was prepared in the same manner as described in Example 2, except that fine particles of silicon dioxide were not added to the coating dispersion, to prepare a coating dispersion for the subbing layer having the following composition.

| Composition of Coating Dispersion for Subbing Layer | |
|---|---|
| Polyester resin | 100 parts |
| Methylated melamine | 25 parts |
| Ethylene dichloride | 1375 parts |

COMPARISON EXAMPLE 3

A radiation image storage panel consisting essentially of a support, a subbing layer, a phosphor layer and a transparent protective film was prepared in the same manner as described in Example 3, except that fine particles of silicon dioxide were not added to the coating dispersion, to prepare a coating dispersion for the subbing layer having the following composition.

| Composition of Coating Dispersion for Subbing Layer | |
|---|---|
| Polyurethane resin | 100 parts |
| Methyl ethyl ketone | 1150 parts |

The radiation image storage panels prepared as described above were evaluated on the occurrence of cracks and the bonding strength between the phosphor layer and the support according to the following tests.

(1) Occurrence of Cracks

The radiation image storage panel was cut along the depth direction and the cross-section of the phosphor layer was observed with eyes to evaluate the occurrence of cracks. The results are expressed by the following three levels of A to C.

A: The cracks hardly occurred in the phosphor layer.
B: The cracks occurred in the phosphor layer.
C: The cracks noticeably occurred in the phosphor layer.

(2) Bonding Strength

The radiation image storage panel was cut to give a test strip (specimen) having a width of 10 mm, and the test strip was given a notch along the interface between the phosphor layer and the support provided with the subbing layer. In a tensile testing machine (Tensilon UTM-II-20 manufactured by Toyo Balodwin Co., Ltd., Japan), the support part and the part consisting of the phosphor layer and protective film of the so notched test strip were forced to separate from each other by pulling one part from another part in the rectangular direction (peel angle: 90°) at a rate of 10 mm/min. The bonding strength was determined just when a 10-mm long phosphor layer portion was peeled from the support. The strength (peel strength) is expressed in terms of the force F (g./cm).

The results of the evaluation on the radiation image storage panels are set forth in Table 1.

TABLE 1

| | Occurrence of Cracks | Bonding Strength (g./cm) |
|---|---|---|
| Example 1 | A | 320 |
| Com. Example 1 | B | 360 |
| Example 2 | A | 250 |
| Com. Example 2 | B | 280 |
| Example 3 | A | 300 |
| Com. Example 3 | C | 350 |

As is evident from the results set forth in Table 1, the radiation image storage panels according to the present invention (Examples 1–3) were free from occurrence of cracks in the phosphor layer. In contrast, there occurred cracks in the phosphor layer in the conventional radiation image storage panels (Comparison Examples 1–3).

The bonding strength between the phosphor layer and the support in each of the panels according to the present invention (Examples 1–3) was lower than that in the each corresponding conventional panel (Comparison Examples 1–3) as shown in Table 1, but prominently higher than a panel having no subbing layer. For example, a radiation image storage panel prepared in the same manner as described in Example 1 except that no subbing layer was provided on the support had a bonding strength of 30 g./cm, and the bonding strength in the panels of Examples 1–3 was apparently higher than 30 g./cm.

Further, it is evident from the results of eye observation that the radiation image storage panels of the present invention (Examples 1–3) substantially had no lamination wrinkles on the surface of the protective film, and that the curling of panel was not produced. Thus, it was confirmed that a satisfactorily plane panel was prepared. On the contrary, the conventional radiation image storage panels (Comparison Examples 1–3) had a considerable number of lamination wrinkles thereon and the curling of panel was observed.

We claim:

1. A radiation image storage panel comprising a support, a subbing layer and a phosphor layer which comprises a binder and a stimulable phosphor dispersed therein, superposed in this order, characterized in that said subbing layer contains fine particles having a size of 1–30 μm in an amount of 1–200% by weight of a resin constituting the subbing layer.

2. The radiation image storage panel as claimed in claim 1, in which said fine particles are contained in the subbing layer in an amount of 5–99% by weight of the resin.

3. The radiation image storage panel as claimed in claim 2, in which said fine particles are contained in the subbing layer in an amount of 10–60% by weight of the resin.

4. The radiation image storage panel as claimed in any one of claims 1 through 3, in which said fine particles are of silicon dioxide.

5. The radiation image storage panel as claimed in any one of claims 1 through 3, in which said resin of the subbing layer is at least one resin selected from the group consisting of polyacrylic resins, polyester resins, polyurethane resins, polyvinyl acetate resins and ethylene-vinyl acetate copolymer.

6. The radiation image storage panel as claimed in claim 5, in which said resin of the subbing layer is crosslinked with a crosslinking agent.

7. The radiation image storage panel as claimed in claim 6, in which said crosslinking agent is at least one compound selected from the group consisting of isocyanate, a derivative thereof, melamine, a derivative thereof, amino resin, and a derivative thereof.

8. The radiation image storage panel as claimed in claim 1, in which a protective film of a plastic material is provided on said phosphor layer.

* * * * *

UNITED STATES PATENT AND TRADEMARK OFFICE

CERTIFICATE OF CORRECTION

PATENT NO. : 4,567,371

DATED : January 28, 1986

INVENTOR(S) : Akio ISHIZUKA, Hisashi YAMAZAKI and Kikuo YAMAZAKI

It is certified that error appears in the above-identified patent and that said Letters Patent is hereby corrected as shown below:

On the cover page of the Patent, under item [30], delete "February 8, 1983", and substitute --August 2, 1983-- therefor.

Signed and Sealed this

*Twenty-ninth* Day of *July 1986*

[SEAL]

*Attest:*

DONALD J. QUIGG

*Attesting Officer*

*Commissioner of Patents and Trademarks*